US005213527A

United States Patent [19]

Fetchko

[11] Patent Number: 5,213,527

[45] Date of Patent: May 25, 1993

[54] MARINE POWER STEERING ACTUATOR SYSTEM

[75] Inventor: Eric B. Fetchko, Burnaby, Canada

[73] Assignee: Teleflex (Canada) Limited, Richmond, Canada

[21] Appl. No.: 803,426

[22] Filed: Dec. 6, 1991

[51] Int. Cl.[5] ..... B63H 25/42

[52] U.S. Cl. ..... 440/61; 114/150

[58] Field of Search ..... 440/61, 62, 63; 114/150; 137/625.66

[56] References Cited

U.S. PATENT DOCUMENTS

| | | | |
|---|---|---|---|
| 2,891,498 | 6/1959 | Schroeder | 440/61 |
| 4,592,732 | 6/1986 | Ferguson | 440/63 X |
| 4,595,370 | 6/1986 | Small | 440/62 X |
| 4,892,494 | 1/1990 | Ferguson | 440/61 |
| 4,976,639 | 12/1990 | Rawlings et al. | 440/59 |

FOREIGN PATENT DOCUMENTS

| | | | |
|---|---|---|---|
| 3922669 | 2/1990 | Fed. Rep. of Germany | 440/61 |

*Primary Examiner*—Sherman Basinger
*Attorney, Agent, or Firm*—Norman M. Cameron

[57] ABSTRACT

An hydraulic actuator assembly for a power steering ram of a marine inboard/outboard drive of the type where the ram is connected to a tiller arm and has a spool valve mounted on the ram. The spool valve has a fastening tube which opens the spool valve when displaced in either direction to supply hydraulic fluid to the ram to move the tiller arm in the direction the fastening tube is displaced. The assembly includes an hydraulic actuator having a cylinder with an internal piston and a rod connected to the piston and sealingly extending from a first end of the cylinder. The rod has a distal end which connects to the tiller arm. The cylinder has a connector on a second end thereof. There is a mounting bracket extending generally radially from the cylinder which has a first end connected to the connector of the cylinder and a second end which is distal with respect to the cylinder. The second end has an aperture for connecting the bracket to the fastening tube of the spool valve. The actuator may have a stroke limiter for preventing excessive travel of the ram including a passageway through the piston and a normally closed valve on the passageway. A rod extends slidably through the passageway and beyond the piston to open the valve before the piston reaches the end of the cylinder.

11 Claims, 2 Drawing Sheets

MARINE POWER STEERING ACTUATOR SYSTEM

BACKGROUND OF THE INVENTION

1. Field of the Invention

This invention relates to improved hydraulic actuator systems for marine inboard/outboard drive units.

2. Description of Related Art

Hydraulic rams are used to provide power steering for marine inboard/outboard drive units, such as those sold under the trade mark Volvo. In one type of unit an hydraulic ram has an actuator rod connected to the tiller arm of the inboard/outboard unit and extends to one side thereof. The operation of the ram is governed by a servo mounted on top of the ram which includes a spool valve which is spring loaded to a center, closed position. A mounting tube extends outwardly from the spool valve parallel to the actuator rod of the ram. When the tube is displaced in one direction, the spool valve opens to allow hydraulic fluid to enter the ram so the ram is activated in the same direction as the tube. The ram moves until the ram has been displaced the same distance as the mounting tube. The same thing occurs when the mounting tube is displaced in the opposite direction.

Movement of the mounting tube can be accomplished by a system of cables which extend forwardly from the drive unit to the helm of the boat. However, operation of the steering system is improved, and the need for cables eliminated, by using an hydraulic actuator to the move the mounting tube of the spool valve. Hydraulic lines then connect the drive unit to the helm which is connected to an hydraulic pump. One type of hydraulic actuator system is sold by Volvo in their Kit No. 1140585-9. The hydraulic actuator in this system is clamped to a pair of spaced-apart brackets which are connected to the mounting tube on opposite sides of the servo. The clamping of the cylinder is accomplished by tightening a pair of bolts on the clamps of each of the brackets. This method of mounting the actuator is disadvantageous for a number of reasons. First, the system relies on friction to hold the actuator in place. If the bolts become loose, then the actuator can slip axially, causing steering disfunction. This may not become apparent until the loading on the mounts is greater than usual, such as occurs if the power steering ram should fail. The power steering actuator can provide enough power to steer the boat, with considerably increased steering effort, should the ram fail. However, the loading on the clamps is considerably increased and the cylinder may slip under such an extreme emergency condition.

Furthermore, over-tightening the bolts is also undesirable. This can deform the cylinder of the actuator, causing the piston to stick slightly as it passes the deformed section of the cylinder adjacent the clamp. This gives an undesirable "lumpy" feeling to the steering and may cause oversteering when the piston frees itself after moving past the deformed portion of the cylinder.

As a result, there is a need to provide an improved hydraulic actuator mounting system which is less subject to malfunction if a few bolts are under-tightened or over-tightened as sometimes occurs for bolts or nuts which are easibly accessible to installers or repairmen.

SUMMARY OF THE INVENTION

The invention provides an hydraulic actuator assembly for a power steering ram of a marine inboard/outboard drive of the type where the ram is connected to a tiller arm and has a spool valve mounted on the ram. The spool valve has a fastening tube which opens the spool valve when displaced in either direction to supply hydraulic fluid to the ram to move the tiller arm in the same direction the fastening tube is displaced. The assembly comprises an hydraulic actuator having a cylinder with first and second ends. The cylinder has an internal piston and a rod connected to the piston which sealingly extends from the first end of the cylinder. The rod has a distal end with means for connecting the rod to the tiller arm. The cylinder has a connector on the second end. A mounting bracket extends generally radially from the cylinder and has a first end connected to the connector of the cylinder and a second end which is distal with respect to the cylinder. The second end has means for connecting the bracket to the fastening tube of the spool valve.

The invention also provides an actuator for a marine drive power steering ram which includes an hydraulic cylinder with a piston slidably received therein. An actuator rod is connected to the piston and extends outwardly from the cylinder. There is a stroke limiter for preventing excessive travel of the ram. The stroke limiter includes a passageway through the piston and a normally closed valve along the passageway. There is means for opening the valve before the piston reaches one end of the cylinder.

For example, the passageway may be a straight conduit which extends through the piston parallel with the actuator rod. In this case the valve is a check valve and the means for opening is a rod slidably extending through the conduit, having a first end operatively contacting the check valve and a second end extending outwardly beyond the piston.

The actuator assembly according to the invention provides a relatively simple and economical mount for the actuator when compared to the prior art. Moreover, the actuator is mechanically held in the correct position instead of relying on friction as in some of the prior art. Since the mounting is accomplished by a connection on an end of the cylinder, deformation of the cylinder cannot occur as with some prior art devices.

DESCRIPTION OF THE PREFERRED EMBODIMENTS

Figure 1:
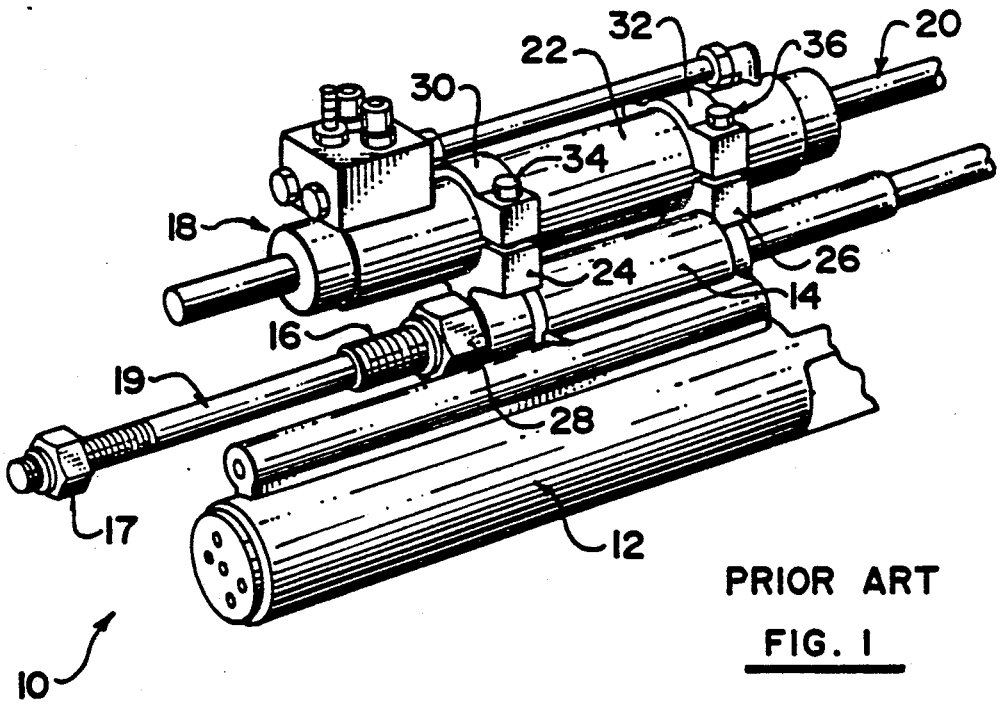
PRIOR ART FIG. 1
FIG. 1 is a fragmentary, isometric view of an hydraulic actuator assembly for a marine power steering unit according to the prior art.

FIG. 1 shows part of a prior art marine power steering system 10 for an inboard/outboard unit of a type marketed by Volvo (Trade Mark). An hydraulic ram 12 is connected to the tiller arm (not shown) and has a servo 14 mounted on the top thereof. The servo comprises a spring-loaded spool valve with a mounting tube 16 extending therefrom. Hydraulic actuator 18 is used to move the valve spool in either direction and consequently to supply hydraulic fluid to the ram to move the tiller arm in the same direction. Rod 20 of actuator 18 is connected to the tiller arm which is located to the right from the point of view of FIG. 1. Cylinder 22 is mounted on the mounting tube 16 by means of a pair of brackets 24 and 26. Nuts are used to hold the brackets on the mounting tube, for example nut 28 as seen for bracket 24.

The brackets 24 and 26 have clamps 30 and 32 on the tops thereof. Cylinder 22 of actuator 18 is secured in these clamps by tightening bolts on the clamps including bolts 34 and 36 seen in FIG. 1 and similar bolts on the opposite sides of the clamps. The disadvantages of this system relying upon friction and clamping of the cylinder 22 are discussed above.

Figure 2:
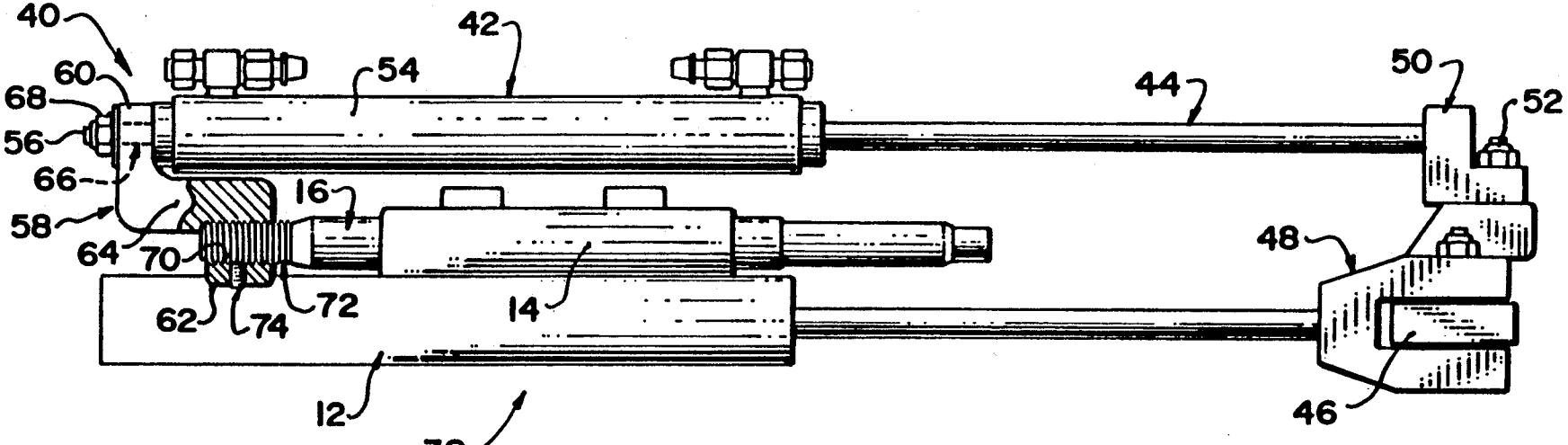
FIG. 2 is a side elevation, partly in section, of a power steering actuator system for a marine inboard/outboard power steering unit according to an embodiment of the invention.

Hydraulic actuator assembly 38, shown in FIG. 2, overcomes these problems with an improved mounting system 40 for its hydraulic actuator 42. The same ram 12 and servo 14 with mounting tube 16 are used as in the prior art of FIG. 1. Actuator 42 has a rod 44 connected to tiller arm 46 by a clevis block 50 which is secured to clevis 48 of the ram 12 by bolt 52. A pin could be used instead of the bolt.

The actuator 42 of this embodiment is unbalanced although the invention also applies to a balanced actuator as described below. It includes a cylinder 54 which has a threaded stud 56 extending axially from the end thereof opposite the rod 44.

A mounting bracket 58 is connected to stud 56 and is generally Z-shaped in this example with a pair of mounting flanges 60 and 62 extending in opposite directions away from a central web 64. Other shapes of brackets could be substituted and may be more than one piece. Flange 60 has an aperture 66 which is fitted over stud 56. A nut 68 is tightened on the stud to secure the mounting bracket to the end of cylinder 54.

Mounting bracket 58 is similar to brackets used previously for other purposes. Two such brackets are used, for example for mounting hydraulic steering actuators for outboard motors and sold under the trademark TELEFLEX. It may be observed that the bracket has a jog therein at web 64 which allows actuator 42 to extend to the left beyond servo 14.

Flange 62 has an aperture 70 with female threads which are complementary to male threads 72 of mounting tube 16. There is a lock screw 74 extending threadly through bracket 58 to engage mounting tube 16 and secure it in any desired rotational position. Adjustment of the mounting tube, and consequently of the spool valve, with respect to actuator 42 can be accomplished by loosening the lock screw and rotating the mounting tube to move it further into or out of threaded aperture 70 and therefore make an axial adjustment of the servo with respect to the power steering actuator. The lock screw is tightened after the correct adjustment is made.

Figure 3:
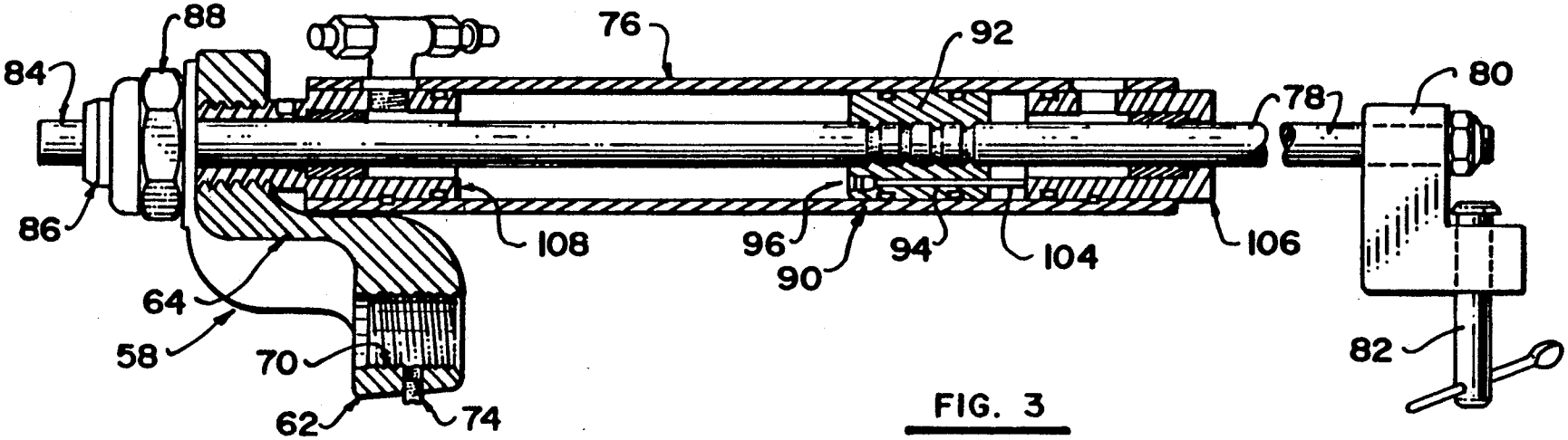
FIG. 3 is a side elevation, partly in section, of a mounting bracket similar to that shown in FIG. 2 with an alternative balanced power steering actuator having an internal stroke limiter.

FIG. 3 shows an alternative embodiment of the invention which is generally similar to that of FIG. 2. Accordingly, it is described only with respect to the differences relating thereto. The same bracket 58 is employed. However, a balanced power steering actuator 76 is employed in this case. As before, actuator rod 78 is connected to a clevis block 80 which, in this case, has a clevis pin 82 for mounting on the clevis of the tiller arm. However, because this is a balanced actuator, rod 78 has an end 84 which extends slidably from the actuator at the same end as bracket 58. Therefore, a threaded stud cannot be placed on the end of the actuator. Instead, there is a threaded collor 86 extending about end 84 of rod 78. A nut 88 is used to secure the bracket over the threaded collar against the end of the actuator. Alternatively, the bracket could be connected to the actuator by having threads in aperture 66 of the bracket itself and omitting the nut.

A second variation in the embodiment of FIG. 3 is the inclusion of an internal stroke limiter 90 in the actuator. This is used to protect the engine driven power steering pump. If a boat operator steers the boat hard over, and the power steering ram reaches the end of its stroke before the power steering actuator reaches its limit, the power steering valve would remain open. This causes the engine driven pump to bypass pressure across its relief valves, creating large amounts of heat which may adversely affect the engine pump. This is unlikely to occur, but the prior art device shown in FIG. 1 includes means to overcome this problem. There is a nut 17 on a threaded rod 19 extending through the mounting tube. When the power steering ram is near hard over, but not at its limit, this nut hits the mounting tube and centers the spool valve to stop pressurized hydraulic fluid from entering the ram. In the other direction, the clevis mount strikes the end of the mounting tube and centers the valve to deactivate the power steering ram.

The embodiments of the invention shown in FIG. 2 and 3 also use the clevis blocks 50 and 80 to center the spool valve in one direction and deactivate the ram. However, the embodiment of FIG. 3 includes internal stroke limiter 90 for use in the opposite direction of movement as seen in better detail in FIG. 4. It should be understood that internal stroke limiters are optional features for both balanced and unbalanced actuators, such as actuator 42 of FIG. 2.

Piston 92 within the actuator has a straight conduit 94 which extends through the piston from one side to the other parallel to its rod 78. A check valve 96 is located on the conduit adjacent the left side of the piston from the point of view of FIG. 3. This is a normally closed check valve of the conventional type including ball 98 normally held on a seat 100 by a coil spring 102.

Figure 4:
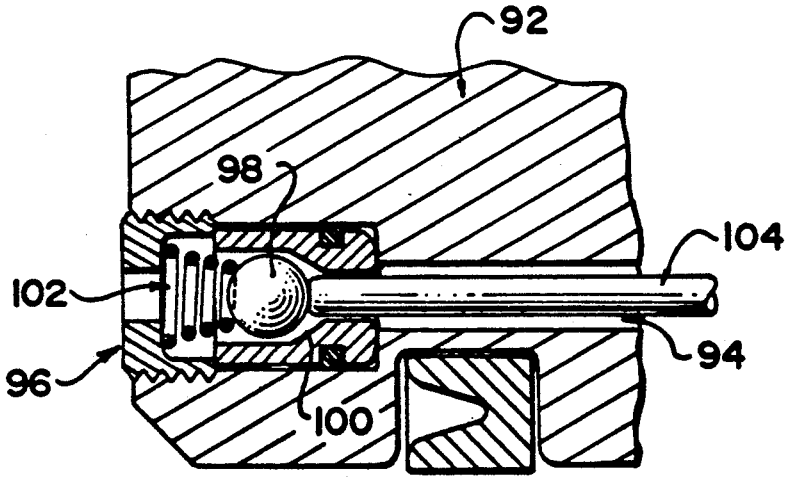
FIG. 4 is an enlarged, fragmentary section of the internal stroke limiter from FIG. 3.

A straight rod 104 extends loosely through conduit 94 outwardly beyond the piston to the right from the point of view of FIG. 3 and 4. The opposite end of the rod contacts ball 98. When piston 92 is moved near its limit of travel to the right, the rod contacts end gland 106 of the actuator, unseats ball 98 and allows pressurized fluid to move from the left side to the right side of the piston, thereby deactivating the hydraulic actuator and allowing the spring-biased valve spool of servo 14 to center, deactivating the hydraulic ram.

Alternatives and Variations

In another embodiment, bracket 58 is integral with end gland 108 of actuator 76 instead of being threadedly connected thereto.

The bracket may be non-coaxially connected to the actuator instead of being coaxially connected as shown in the drawings.

Aperture 70 on flange 62 of bracket 58 can be unthreaded with nuts used to connect it to the mounting tube. Other means may also be used to connect the bracket to the tube.

Stroke limiter 90 may also be used in the opposite direction of travel of the piston of the actuator by having rod 104 project to the left instead of to the right from the point of view of FIG. 3 and 4 with the check valve on the right side of the piston. When used for this direction of travel in an unbalanced actuator 42, as shown in FIG. 2, there is an additional benefit. The area of the left of the piston is greater than that on the right where the area of the rod is substracted. Therefore, after the hydraulic pressure is equalized by the stroke limiter rod contacting the gland at the left end of the actuator, there is still a force acting on the left side of the piston. This helps re-center the valve spool instead of just relying on its spring.

It will be understood by someone skilled in the art that many of the details provided above are by way of example only and can be altered or eliminated without departing from the scope of the invention which is to be interpreted with reference to the following claims:

What is claimed is:

1. An hydraulic actuator assembly for a power steering ram of a marine inboard/outboard drive of the type where the ram is connected to a tiller arm and has a spool valve mounted on the ram, the spool valve having a mounting tube which opens the spool valve when displaced in either direction to supply hydraulic fluid to the ram and to move the tiller arm in the direction the mounting tube is displaced, the assembly comprising:

an hydraulic actuator having a cylinder with first and second ends, an internal piston and a rod connected to the piston which sealingly extends from the first end of the cylinder, the rod having a distal end with means for connecting the rod to the tiller arm, the cylinder having a connector on the second end; and a mounting bracket extending generally radially from the cylinder, having a first end connected to the connector of the cylinder and a second end which is distal with respect to the cylinder, the second end having means for connecting the bracket to the mounting tube of the spool valve.

2. An assembly as claimed in claim 1, wherein the connector on the cylinder includes a male threaded member extending from the cylinder, the first end of the bracket having an aperture for receiving the male threaded member, the connector including a nut received on the male threaded member on the side of the bracket opposite the cylinder.

3. An assembly as claimed in claim 2, wherein the actuator is unbalanced, the male threaded member being a stud.

4. An assembly as claimed in claim 2, where in the actuator is balanced, the male threaded member being a threaded collar, the rod extending slidably through the collar.

5. An assembly as claimed in claim 1, wherein the bracket has a jog therein, the first end being displaced outwardly beyond the second end with respect to the spool valve.

6. An assembly as claimed in claim 5, wherein the bracket is generally Z-shaped with two parallel flanges extending outwardly in opposite directions and a connecting web between the flanges and generally perpendicular thereto.

7. An assembly as claimed in claim 1, wherein the means on the second end of the bracket is a threaded aperture, the mounting tube of the spool valve having a complementary male thread received in the aperture.

8. An assembly as claimed in claim 1, wherein the actuator has means for limiting the stroke of the ram including a conduit extending from one side of the piston to another side thereof, a normally closed valve on the conduit and means for opening the valve before the piston reaches one end of the cylinder to relieve pressure in the cylinder and allow the spool valve to close.

9. An assembly as claimed in claim 8, wherein the conduit is straight and extends through the piston parallel with the rod of the cylinder, the valve being a check valve and the means for opening being a rod slidably extending through the conduit, having a first end operatively contacting the check valve and a second end extending outwardly beyond the piston.

10. A power steering assembly for a marine inboard/-outboard drive equipped with a tiller arm, the assembly comprising:

a power steering ram having an actuating rod connected to the tiller arm;

a steering servo mounted on the ram having a spool valve and a threaded mounting tube extending outwardly from the spool valve;

a power steering actuator including an hydraulic cylinder having an actuator rod extending from a first end which is connected to the tiller arm and a threaded connector on a second end of the cylinder; and a mounting bracket connected to the actuator by the threaded connector and being connected to the mounting tube of the steering servo, the bracket being generally Z-shaped with two parallel flanges extending outwardly from a central web in opposite directions, the flanges having apertures for receiving the threaded connector of the actuator and the mounting tube respectively, the flange connected to the actuator being displaced axially outwards with respect to the steering servo to accommodate a power steering actuator which extends outwardly beyond the servo.

11. An assembly as claimed in claim 10, wherein the bracket is connected to the threaded connector by a nut and having a threaded aperture for engaging the mounting tube.

* * * * *